United States Patent [19]

Figueroa

[11] Patent Number: 5,062,030

[45] Date of Patent: Oct. 29, 1991

[54] CUSTOMIZED LIGHT REFLECTOR

[76] Inventor: Luisito A. Figueroa, c/o Excel Products, Inc., Suite 504 Jovan Condominium, 600 Shaw Blvd., Mandaluyong, Metro Manila, Philippines

[21] Appl. No.: 624,605

[22] Filed: Dec. 10, 1990

[51] Int. Cl.[5] ..... F21V 7/12

[52] U.S. Cl. ..... 362/346; 362/241; 362/260

[58] Field of Search ..... 362/241, 260, 346, 341

[56] References Cited

U.S. PATENT DOCUMENTS

| | | | |
|---|---|---|---|
| 2,323,073 | 6/1943 | Netting | 362/225 |
| 4,499,529 | 2/1985 | Figueroa | 362/283 |
| 4,719,546 | 1/1988 | Spitz | 362/260 |
| 4,779,178 | 10/1988 | Spitz | 362/260 |
| 4,814,954 | 3/1989 | Spitz | 362/217 |
| 4,855,883 | 8/1989 | Spitz | 362/260 |
| 4,975,812 | 12/1990 | Cole, Jr. | 362/225 |

FOREIGN PATENT DOCUMENTS

| | | | |
|---|---|---|---|
| 114238 | 9/1979 | Japan | 362/241 |

*Primary Examiner*—Ira S. Lazarus
*Assistant Examiner*—L. Heyman
*Attorney, Agent, or Firm*—Julian Caplan

[57] ABSTRACT

A light reflector for specific use in combination with a lighting fixture having one or more elongate light source such as fluorescent lamp is disclosed. It has a plurality of angled planar light reflecting surfaces disposed behind and symmetrically of the light source and includes a central reflecting surface. The light reflector is so dimensioned and substantially configured such that it could readily be assembled and/or fitted about in all existing fixtures. For instance, one or two reflectors could readily fit to two or four-bulb lighting fixtures, respectively.

12 Claims, 3 Drawing Sheets

CUSTOMIZED LIGHT REFLECTOR

BACKGROUND OF THE INVENTION

This invention relates generally to a light reflector specifically intended to customize with the standard lighting fixture having one or more light sources such as fluorescent bulb.

The art of lighting fixture while extremely old has experienced an increase in activity in recent years, with the development of a new and specialized light reflectors for securement on said fixture, said reflectors being appreciably adapted to achieve maximum illumination and uniform distribution of light rays intensity throughout the area to be lighted. Commonly available lighting fixtures include a ceiling mounted housing which comes out in a variety of sizes and shapes, and suited to accommodate one or more bulbs.

Research in this field has established the fact that when the specific need arises for a light reflector to be installed to the housing of the existing lighting fixture, daily users of the fixture often find it difficult in procuring a ready to fit customized light reflector. In said typical situation, they usually resort to a made-to-order light reflector which entails more expenditure aside from the inconveniences inherent thereto.

In view of the defects found in the utilization of the aforementioned existing light reflectors made for conventional lighting fixtures, the inventor, upon a sustained effort, has developed the present customized reflector which is noteworthy for its simple and easy assembly, more reliable and very practical for use.

SUMMARY OF THE INVENTION

In accordance with the present invention, the light reflector has a plurality of light reflecting planar surfaces inclined towards the light source and capable of directing the light rays downwardly and uniformly over a greater area. The light reflecting planar surfaces may be fixed and in which case, the angular disposition of each of the planar surfaces are predetermined.

The light reflector's embodiments proposed by the invention, comprises different specific configurations which may be utilized in accordance with the teaching disclosed in my previous invention bearing U.S. Pat. No. 4,499,529 issued on Feb. 12, 1985. An important feature of the invention are a pair of arcuated wing sections each defining a series of light reflective angled planar surfaces symmetrically joined to a central section, said sections being capable, of directing the light rays downwardly and uniformly in a more intense manner. It maximizes the illumination emitted by the light source, as it utilizes maximally the light rays emitted thereby.

The angled planar reflecting surfaces are positioned symmetrically and coextensively of the elongate light source. They are mounted and define a generally concave contour. The reflecting surfaces are coated with aluminum or silver by vacuum metallization process to effectively intercept and reflect light emitted by the light source.

The reflector proposed by the invention is so dimensioned and configured such that its size and shape could be readily assembled and/or customized to about all existing standard lighting fixtures. For instance, a four-bulb elongate light source could be fitted easily with two of these reflectors to attain the desired maximum illumination of a predetermined area to be lighted.

Other objects and advantages of the invention will be fully understood from the following detailed description of the preferred embodiment when read in conjunction with the appended drawings.

DETAILED DESCRIPTION OF THE PREFERRED EMBODIMENTS

Figure 1:
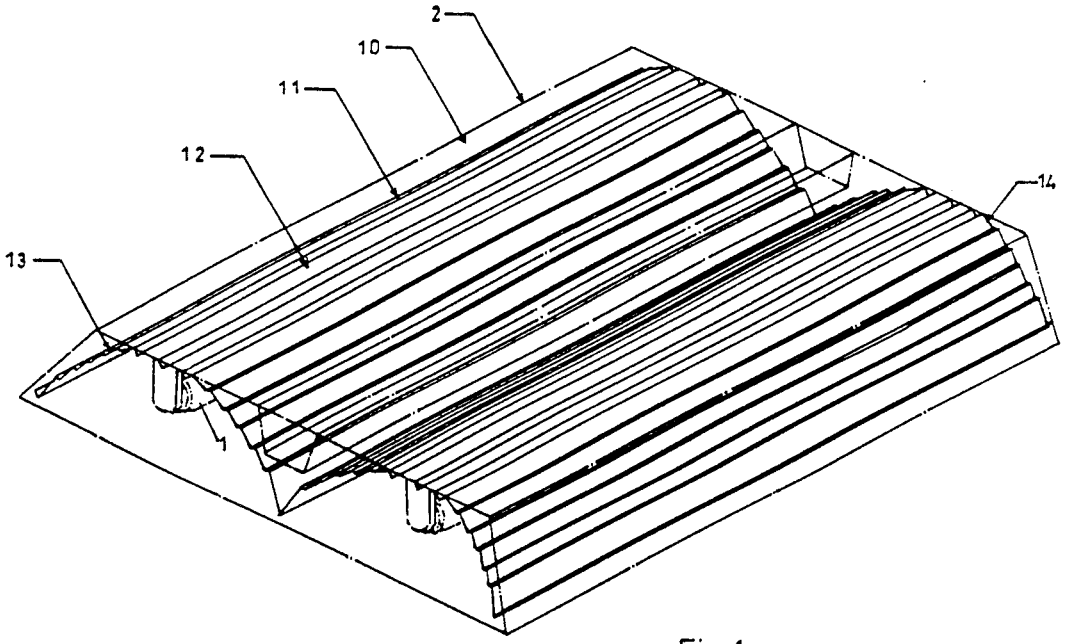
FIG. 1 is a perspective of a light reflector in accordance with the invention.
Figure 2:
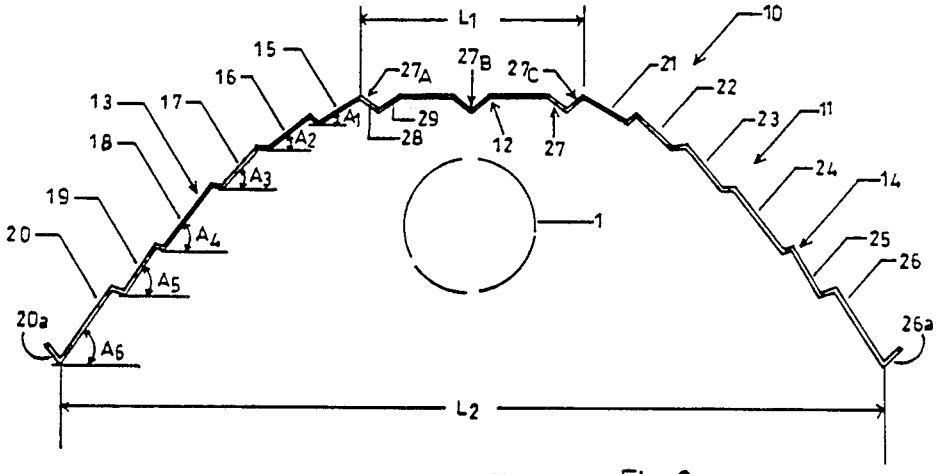
FIG. 2 is a side elevational view of the light reflector shown in FIG. 1.

Referring now in detail to the drawings, particularly to the first embodiment of the invention, there is illustrated in FIGS. 1 and 2 the light reflector generally designated by reference numeral 10. Said light reflector 10 comprises a substantially concave element 11 formed from a rigid sheet of predimensioned metal sheet or plastic material. The underside of the sheet should be coextensively lined with excellent light reflecting material, such as aluminum or silver by vacuum metallization process.

The concave element 11 substantially extends in a coaxial parallel longitudinal direction along a light source 1. Said element 11 comprises a central light reflecting section 12 and a pair of light reflecting wing sections, such as 13 and 14, which are arcuated and symmetrically positioned on either side of said central section 12 so as to create said concave configuration of the element 11. Each of said wing sections 13 and 14 have at least six individually dimensioned and oriented light reflective angled planar surfaces, respectively indicated by the reference numerals 15, 16, 17, 18, 19 and 20, and the numerals 21, 22, 23, 24, 25, 26. Connecting said arcuated and symmetrical light reflecting wing sections 13 and 14 is the central light reflecting section 12. Said central section 12 includes at least two V-shaped reflecting surfaces 27 spaced in parallel, each of said surfaces 27 defining two opposed intersecting reflecting planar surfaces 28 and 29 being with a centrally positioned apex. Said reflecting surfaces 28 and 29 being positioned at approximately 25 to 35 degrees relative to the horizontal. Light rays emitted from the light source 1 impinge on the reflecting planar surfaces of the element 11 and are reflected away from said light source 1 thereby preventing light source illumination loses generated thereon by diffusion and in a substantially glare-free manner. The outermost and widest planar reflective surfaces 20 and 26 each is provided with an outwardly projecting inclined extensions 20*a* and 26*a* at the free ends thereof.

For ideal configuration so as to readily fit to an existing fixture, the arcuated light reflective surfaces of each wing section 13 and 14 together with the central section 12 of the light reflector should approximate the following characteristics:

(a) The first planar reflective surfaces 15 and 21 closest to the central section 12 is approximately 13 to 17 millimeters wide and inclined at an angle in the range of approximately 24 to 34 degrees ($A_1$) relative to the horizontal;

(b) The primary intermediate reflective section defining the second and third planar reflective surfaces 16 and 22 and 17 and 23 closest to the said first planar reflective surfaces 15 and 21, both approximately 15 to 19 millimeters wide and respectively inclined at an angle of approximately 31 to 41 degrees ($A_2$) and 41 to 51 degrees ($A_3$) relative to the horizontal;

(c) The secondary intermediate reflective section defining the fourth and fifth planar reflective surfaces 18 and 24 and 19 and 25 closest to said third planar surfaces 17 and 23 both approximately 15 to 19 millimeters wide and respectively inclined at an angle of approximately 42.5 to 52.5 degrees ($A_4$) and 47 to 57 degrees ($A_5$) relative to the horizontal;

(d) The outermost and widest planar reflective surfaces 20 and 26 closest to said fifth planar surfaces 19 and 25 which is approximately 24 to 28 millimeters wide and inclined at an angle of 47 to 57 degrees ($A_6$) relative to the horizontal;

(e) The outwardly projecting inclined extensions 20*a* and 26*a* both approximately 1 to 38 millimeters in width;

(f) The central section 12 forming the apex of the reflector which is approximately 6 to 8 cm in width ($L_1$); and (g) The lateral dimension of the span ($L_2$) which is approximately 24 to 28 cm in width.

The reflector 10 is positioned such that it is above and longitudinally coextensive with the said light source 1. The V-shaped reflecting structures 27*a*, 27*b* and 27*c* disposed in the central section 12 is to reinforce and make such section rigid to avoid drooping of wing sections 13 and 14.

Figure 3:
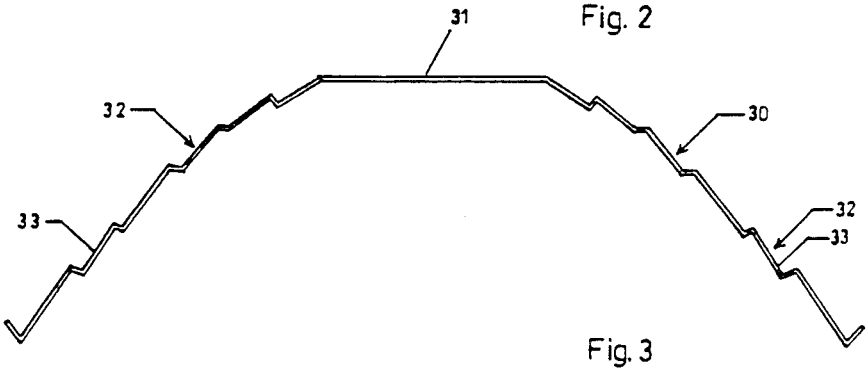
FIG. 3 is a side view of another embodiment of the invention.

The second embodiment of the invention which is illustrated in FIG. 3 of the drawings is generally indicated by reference numeral 30. It comprises a central planar reflective section 31 and a pair of arcuated wing sections 32 symmetrically arranged in parallel on the opposed longitudinal edges of said central planar reflective section 31. Each of said wing sections 32 also define at least six individually dimensioned and oriented light reflective angled planar surface 33 which is substantially structured in the same manner with that of the wing sections 13 and 14 as embodied in FIGS. 1 and 2. As compared to the embodiment shown in said FIGS. 1 and 2, said central section 31 is substantially flat in structure such that light emitted from the light source 1 is reflected in such a manner that greater illumination is focused on the peripheral portion of a predetermined zone or area to be lighted.

Figure 4:
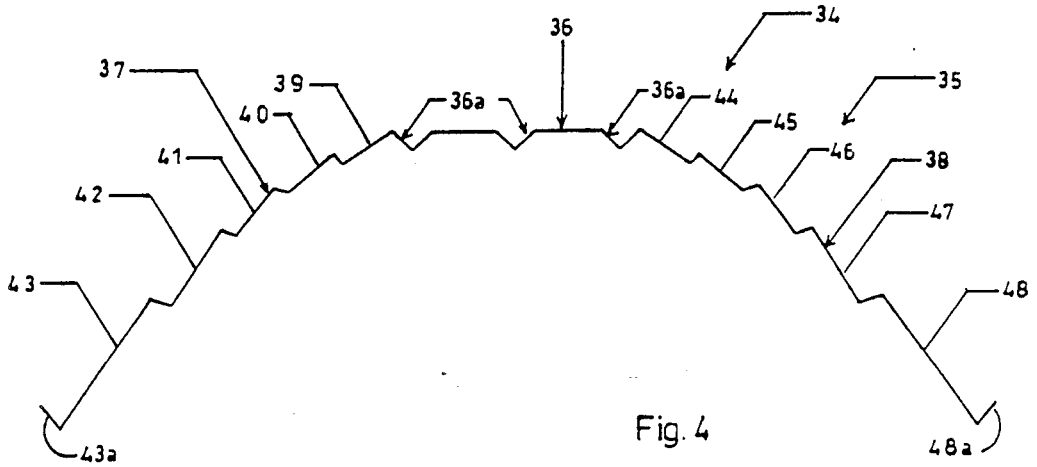
FIGS. 4 and 5 show an schematic end views of another embodiment of the light reflector shown in FIGS. 2 and 3.

The third embodiment of the invention which is illustrated in FIG. 4 of the drawings is generally indicated by reference numeral 34. Said light reflector 34 comprises a concave reflective element 35 defining a central light reflecting section 36 and a pair of light reflecting wing sections 37 and 38 which are arcuated and symmetrically arranged on either side of said central section 36. Each of said wing sections 37 and 38 have at least five indidually dimensioned and oriented light reflective angled planar surfaces respectively indicated by the reference numerals 39, 40, 41, 42, and 43 and numerals 44, 45, 46 47 and 48 for the other side. Connecting said light reflecting sections 37 and 38 is the central light reflecting section 36. Said central section 36 have at least two V-shaped intersecting planar reflecting surfaces 36*a* spaced in parallel, which is substantially structured in the same manner with that of the central section 12 as embodied in FIGS. 1 and 2.

For ideal configuration, the light reflective angled planar surfaces of the wing sections 37 and 38 should approximate the following characteristics:

(a) The first reflective planar surfaces 39 and 44 closest to the central section 36 at approximately 13 to 17 millimeters in width and inclined at an angle of approximately 24 to 34 degrees relative to the horizontal;

(b) The intermediate reflective planar surfaces 40 and 45, 41 and 46, 42 and 47, each at approximately 15 to 19 millimeters in width and respectively inclined at an angle of approximately 31 to 41, 41 to 51, and 42.5 to 52.5 degrees relative to the horizontal; and (c) The outermost and widest reflective surfaces 43 and 48 closest to the surfaces 42 and 47, at approximately 42 to 46 millimeters in width and inclined at an angle of approximately 47 to 57 degrees relative to the horizontal.

Said outermost surfaces 43 and 48 terminate at the free ends thereof with an outwardly projecting inclined extensions 43*a* and 48*a* and approximately inclined in the range from 1 to 38 millimeters in width.

Figure 5:
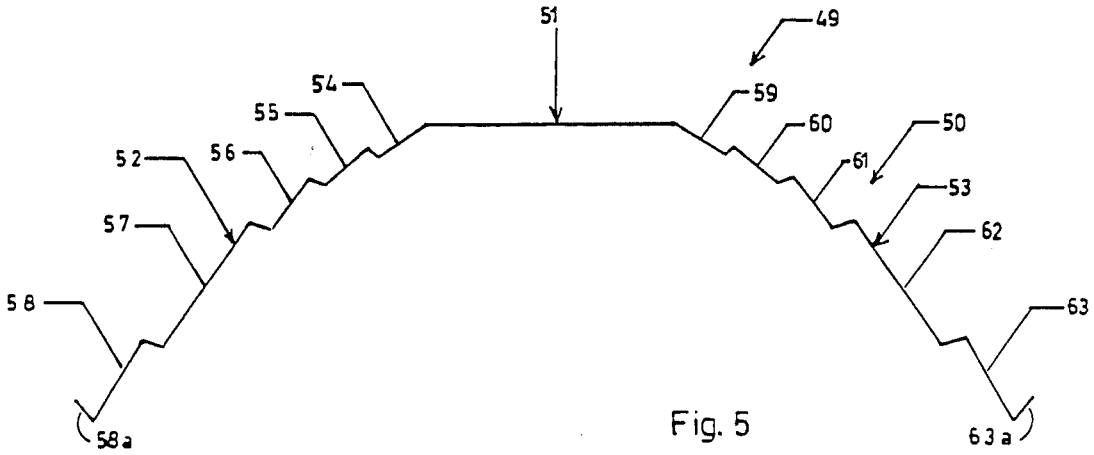

The fourth embodiment of the invention which is illustrated in FIG. 5 of the drawings is generally indicated by reference numeral 49. Said light reflector 49 comprises a concave reflective element 50 defining a central light reflecting section 51 and a pair of light reflecting wing sections 52 and 53 which are arcuated and symmetrically arranged on either side of said central section 51. Each of said wing sections 52 and 53 have at least five individually dimensioned and oriented light reflective angled planar surfaces respectively indicated by the reference numerals 54, 55, 56, 57, and 58 and numerals 59, 60, 61, 62, and 63 for the other side. Connecting said light reflecting sections 52 and 53 is the central light reflecting section 51. Said central section 51 is a flat structure which is substantially fashioned in the same manner with that of the central section 31 as embodied in FIG. 2.

For ideal configuration, the light reflective angle planar surfaces of the wing sections 52 and 53 should approximate the following characteristics:

(a) The first reflective planar surfaces 54 and 59 closest to the central section 51 at approximately 13 to 17 millimeters in width and inclined at an angle of approximately 24 to 34 degrees relative to the horizontal;

(b) The second and third reflective planar surfaces 55 and 60, 56 and 61, each at approximately 15 to 19 millimeters in width and respectively inclined at an angle of approximately 31 to 41 and 41 to 51 degrees relative to the horizontal;

(c) The fourth and widest reflective surfaces 57 and 62 closest to the surfaces 56 and 61, at approximately 32 to 36 millimeters in width and inclined at an angle of approximately 47 to 57 degrees relative to the horizontal; and (d) The fifth and outermost reflective planar surfaces 58 and 63 at approximately 24 to 28 millimeters in width and inclined at an angle of 47 to 57 degrees relative to the horizontal.

Said outermost surfaces 58*a* and 63*a* terminate at the free ends thereof with an outwardly projecting inclined extensions 58*a* and 63*a* both approximately in the range from 1 to 38 millimeters in width.

Figure 6:
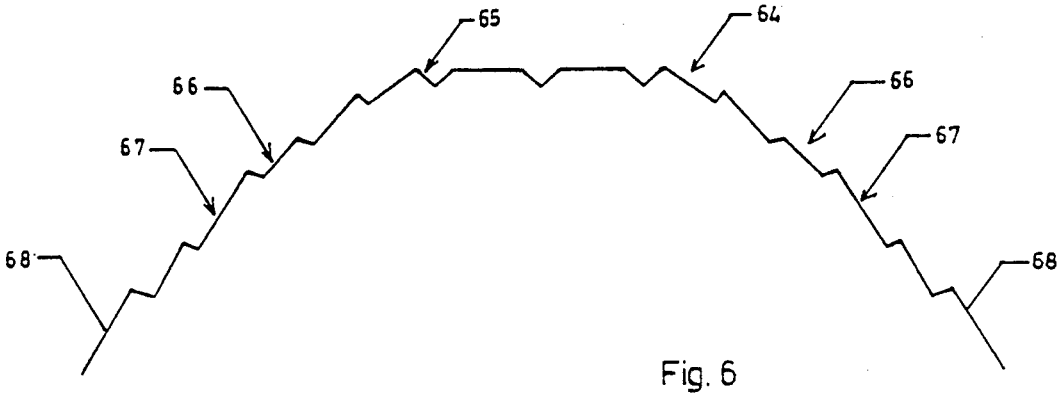
FIG. 6 is an schematic end view of another embodiment of the invention.
Figure 7:
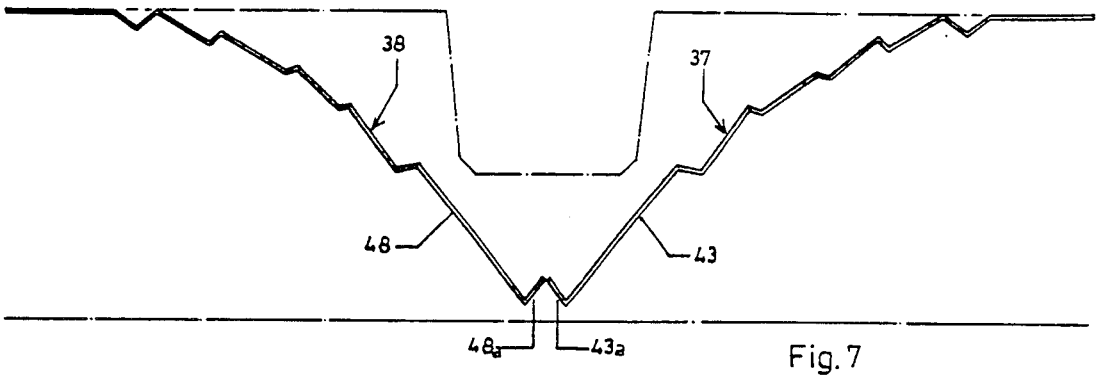
FIG. 7 is an schematic end view of one way of installing a pair of the said light reflectors, e.g., in a two lamp light fixture, the outwardly projecting inclined free ends being in juxtaposed relation.
Figure 8:
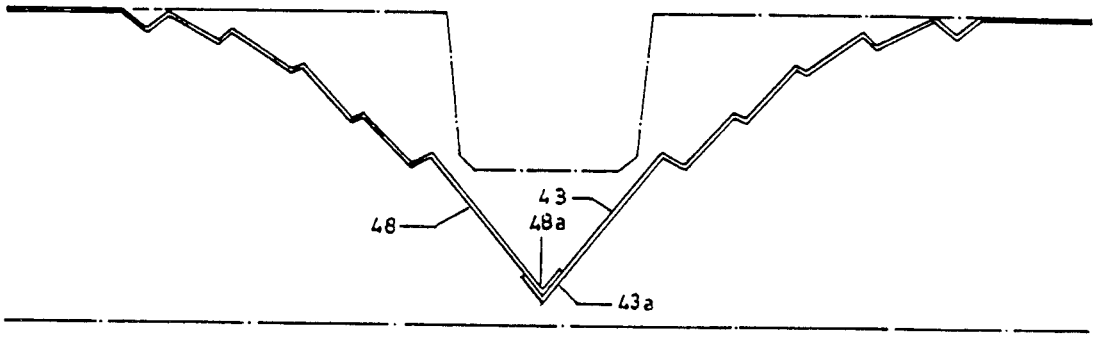
FIG. 8 is another embodiment of installing the light reflector as shown in FIG. 7, the projecting free ends thereof being in superimposed relation.
Figure 9:
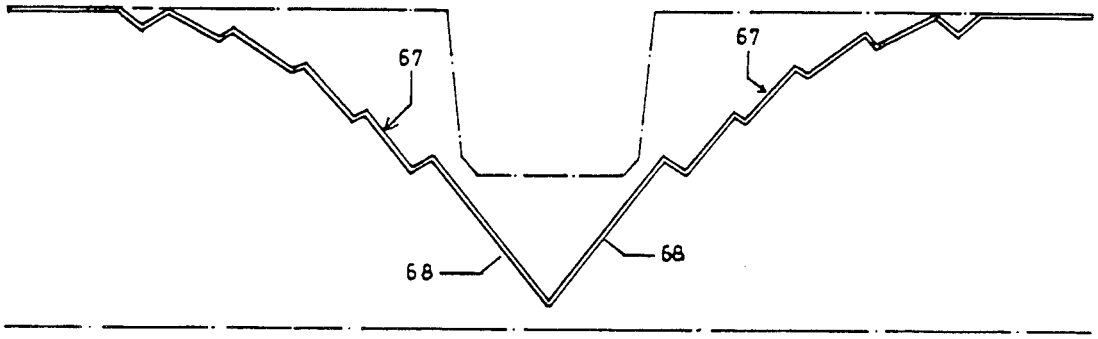
FIG. 9 is a further embodiment of installing the light reflector without the inclined projections.

The fifth embodiment of the invention which is illustrated in FIG. 6 of the drawings is generally indicated by reference numeral 64. It comprises a central planar reflective section 65 and a pair of arcuated wing sections 66 each defining at least six individually dimensioned and oriented light reflective planar surfaces 67. Said surfaces 67 are substantially structured and/or configured in the same manner with that of the wing sections 13 and 14 as embodied in FIG. 2 except that the free ends of the outermost reflective surfaces 68 thereof terminates without no further inclined projection, while the embodiments shown in FIGS. 3, 4 and 5 includes an outwardly projecting inclined extensions, said embodiments could also be fashioned and/or configured without said projections in the same manner with that of FIG. 6.

To attain ideal incidence angles capable of readily fitting the reflector with the existing fixture and at the same time maintain the direction of the light towards and within the lateral boundaries of the area to be lighted, the angled planar reflecting surfaces as disclosed in the embodiments shown in FIGS. 2 to 5 are individually dimensioned and oriented at varying angles, such angles being subjectively influenced by the height and width of the fixtures.

Although the invention has been described with reference to the preferred embodiments disclosed, it will be apparent to a person skilled in the art that various changes may be made without departing from the spirit and scope of the invention as defined by the appended claims.

I claim:

1. A light reflector for use in a lighting fixture with an elongated light source comprising:

a substantially concave light reflecting element disposed in a coaxial parallel longitudinal fashion along a light source, said element having central light reflecting section and a pair of wing sections oppositely positioned parallelly on said central section;

said central section includes at least two V-shaped reflecting section each defining two opposed intersecting reflecting planar surfaces formed with a central apex, said intersecting planar surfaces being positioned at approximately 25–35 degrees relative to the horizontal; and said wing sections are arcuatedly and symmetrically positioned on either side of said central section so as to create a concave configuration, each of said wing section having at least six individually dimensioned and oriented light reflective angled planar surfaces with widths in the range of 13 to 28 millimeters, said light reflective angled planar surfaces being inclined at an angles in the range of 24 to 57 degrees relative to the horizontal, said wing section surfaces being positioned such that the narrowest are adjacent to said central section while the widest surfaces form the outermost portion of said wing sections from said central section;

said central section forming the apex of the reflector having the widths in the range of 6 to 8 cm; and said wing sections having a span in the range of 24 to 28 cm.

2. A light reflector according to claim 1 wherein each of said angled planar surfaces of the wing sections are fixedly positioned about said central reflecting section, each of said wing section includes a first planar surface closest to the central section which is approximately 13 to 17 millimeters wide and inclined at an angle of approximately 24 to 34 degrees relative to the horizontal, a second and third planar surfaces closest to said first planar surface both approximately 15 to 19 millimeters wide and respectively inclined at an angle of approximately 31 to 41 and 41 to 51 degrees relative to the horizontal, fourth and fifth planar surfaces closest to the third planar surface both approximately 15 to 19 millimeters wide and respectively inclined at an angle of approximately 42.5 to 52.5 and 47 to 57 degrees relative to the horizontal, and the outermost and widest planar surface closest to said fifth planar surface which is approximately 24 to 28 millimeters wide and inclined at an angle of approximately 47 to 57 degrees relative to the horizontal, the free end of said extension which is approximately 1 to 38 millimeters in width.

3. A light reflector according to claim 1 wherein said central light reflecting section is substantially flat in structure which symmetrically join together to said wing section light reflective angled planar surfaces.

4. A light reflector according to claim 2 wherein each of said wing sections have at least five individually dimensioned and oriented light reflective angled planar surfaces, each of said wing section includes a first reflective surface closest to the central section which is approximately 13 to 17 millimeters wide and inclined at an angle of approximately 24 to 34 degrees relative to the horizontal, a second, third, and fourth intermediate reflective planar surfaces closest to the first reflective planar surface, each at approximately 15 to 19 millimeters in width and respectively inclined at an angle of 31 to 41, 41 to 51, and 42.5 to 52.5 degrees relative to the horizontal, and the outermost and widest reflective planar surface closest to the fourth intermediate planar surface which is approximately 42 to 46 millimeters in width and inclined at an angle approximately 47 to 57 degrees relative to the horizontal, the free end of said outermost and widest planar surface having an outwardly projecting inclined planar extension which is approximately 1 to 38 millimeters in width.

5. A light reflector according to claim 3 wherein said substantially flat central section is symmetrically joined with a pair of reflecting wing sections, each of said wing sections having at least five individually dimensioned and oriented light reflective planar surfaces which includes a first reflective planar surface closest to said central section which is approximately 13 to 17 millimeters in width and inclined at an angle of approximately 24 to 34 degrees relative to the horizontal, a second and third reflective planar surface closest to said first planar surface, each at approximately 15 to 19 millimeters in width and respectively inclined at an angle of 31 to 41 and 41 to 51 degrees relative to the horizontal, the free end of said fifth and outermost planar surface having an outwardly projecting inclined planar extension which is approximately 1 to 38 millimeters in width.

6. A light reflector according to claim 1 wherein said reflective planar surfaces are lined with a coating of aluminum by vacuum metallization process.

7. A light reflector according to claims 2 or 3 wherein said reflective planar surfaces are lined with a coating of aluminum by vacuum metallization process.

8. A light reflector according to claims 4 or 5 wherein said reflective planar surfaces are lined with a coating of aluminum by vacuum metallization process.

9. A light reflector according to claim 1 wherein said reflective planar surfaces are lined with a coating of silver by vacuum metallization process.

10. A light reflector according to claims 2 or 3 wherein said reflective planar surfaces are lined with a coating of silver by vacuum metallization process.

11. A light reflector according to claims 4 or 5 wherein said reflective planar surfaces are lined with a coating of silver by vacuum metallization process.

12. A light reflector according to claims 2, 4 or 5 wherein the outermost portion of the wing section thereof freely terminates without an outwardly inclined projection.

* * * * *